US005411316A

United States Patent [19]

Lovegrove et al.

[11] Patent Number: 5,411,316

[45] Date of Patent: May 2, 1995

[54] SINGLE PIECE CHAIR SHELL

[75] Inventors: Ross Lovegrove, London, England; Alvin D. Schmidt, Reinholds; Jeffrey D. Crawford, Allentown, both of Pa.

[73] Assignee: Westinghouse Electric Corporation, Pittsburgh, Pa.

[21] Appl. No.: 136,433

[22] Filed: Oct. 13, 1993

[51] Int. Cl.[6] ..... A47C 3/12

[52] U.S. Cl. ..... 297/452.15; 297/452.33; 297/452.34; 297/DIG. 2

[58] Field of Search ..... 297/452.15, 452.14, 297/452.12, 452.11, 452.1, 452.21, 452.23, 452.24, 452.25, 452.29, 452.33, 452.34, 452.36, 452.39, DIG. 2, 285, 286, 290, 300, 306, 353, 354.1

[56] References Cited

U.S. PATENT DOCUMENTS

| | | | |
|---|---|---|---|
| 2,541,835 | 2/1951 | Saarinen | 297/452.14 X |
| 2,808,875 | 10/1957 | Bargen | 297/452.14 |
| 2,993,733 | 7/1961 | Pinkham | 297/452.14 X |
| 3,027,195 | 3/1962 | Nelson et al. | 297/418 |
| 3,201,172 | 8/1965 | Bliss | 297/452.12 X |
| 3,441,310 | 4/1969 | Gale | 297/294 |
| 3,574,400 | 4/1971 | Day | 197/452.14 |
| 3,604,749 | 9/1971 | Parmett | 297/239 |
| 3,628,832 | 12/1971 | Jennings | 297/452.15 X |
| 3,756,656 | 9/1973 | Weick | 297/452.14 X |
| 4,131,315 | 12/1978 | Vogtherr | 297/286 |
| 4,418,958 | 12/1983 | Watkin | 297/452.15 |
| 4,529,247 | 7/1985 | Stumpf et al. | 297/301 |
| 4,609,225 | 9/1986 | Loucks | 297/452.15 X |
| 4,856,845 | 8/1989 | Massonet | 297/286 |
| 4,892,356 | 1/1990 | Pittman et al. | 297/452.15 |
| 4,962,964 | 10/1990 | Snodgrass | 297/452.15 |
| 5,044,691 | 9/1991 | Guichon | 297/239 |
| 5,088,792 | 2/1992 | Guichon | 297/445 |

*Primary Examiner*—Kenneth J. Dorner
*Assistant Examiner*—Milton Nelson, Jr.

[57] ABSTRACT

Disclosed is single piece molded resin chair shell comprised of a seat member, a back member, and a pair of connecting torsion links. The back of the seat member and the bottom of the back member are separated by a collapsed elliptical shaped opening extending between the connecting torsion links. Each connecting torsion link is comprised of a curved, substantially U-shaped channel preferably provided with a plurality of web members projecting from the base of the channel whereby the connecting torsion links torsionally control the deflection of the back member relative to the seat member when pressure is applied against the back member by the user of the chair.

13 Claims, 6 Drawing Sheets

SINGLE PIECE CHAIR SHELL

BACKGROUND OF THE INVENTION

This invention relates to a chair structure. It relates particularly to a single piece molded resin chair shell suitable for use in a variety of chair configurations.

Molded resin chair shells have become popular in recent years for use in the construction of office and residential chairs of contemporary design. Their popularity is also the result of the light weight of the chair, the ease and relatively low cost of manufacture and the ability to produce the chair shell in a variety of colors and textures.

Examples of single piece molded resin chairs are disclosed in the following United States Patents:

| | | |
|---|---|---|
| 3,441,310 | Gale | 1969 |
| 3,604,749 | Parmett | 1970 |
| 4,856,845 | Massonnet | 1989 |
| 5,044,691 | Guichon | 1991 |
| 5,088,792 | Guichon | 1992 |

Many of the single piece molded resin chair shells have not proven satisfactory in service either as a result of them being too rigid and uncomfortable to the user or as a result of a tendency for them to crack or break from the fatigue of repeated flexures of the seat and back during use of the chair.

U.S. Pat. No. 4,529,247 issued in 1985 to Stumpf et al. discloses a single piece molded resin chair shell which uses a plurality of horizontal slots in the seat and vertical slots in the back to provide more comfort to the user by allowing the seat and the back to flex relative to each other in response to the position and weight of the user. These slots and their relative motion control the contour and geometry of the chair shell and as a result limit its comfort to the user.

SUMMARY OF THE INVENTION

It is therefore an object of this invention to provide a single piece molded resin chair shell that is comfortable to the user.

It is a further object of this invention to provide a single piece molded resin chair shell that is easy to manufacture at relatively low cost and is adaptable to the construction of chairs of a variety of configurations.

It is a still further object of this invention to provide a single piece molded resin chair shell that allows for repeated flexures of the seat and back in service without fatigue cracking or failure.

It has been discovered that the foregoing objects can be attained by a single piece molded resin chair shell comprising a seat member, a back member and a pair of connecting torsion links, the back of the seat member and the bottom of the back member being separated by a collapsed elliptical shaped opening extending between the connecting torsion links. Each connecting torsion link is comprised of a curved, substantially U-shaped channel, preferably provided with a plurality of spaced web members projecting from the base of the channel, whereby the connecting torsion links torsionally control the deflection of the back member relative to the seat member when pressure is applied by the user to the back member.

DESCRIPTION OF THE PREFERRED EMBODIMENT

Figure 1:
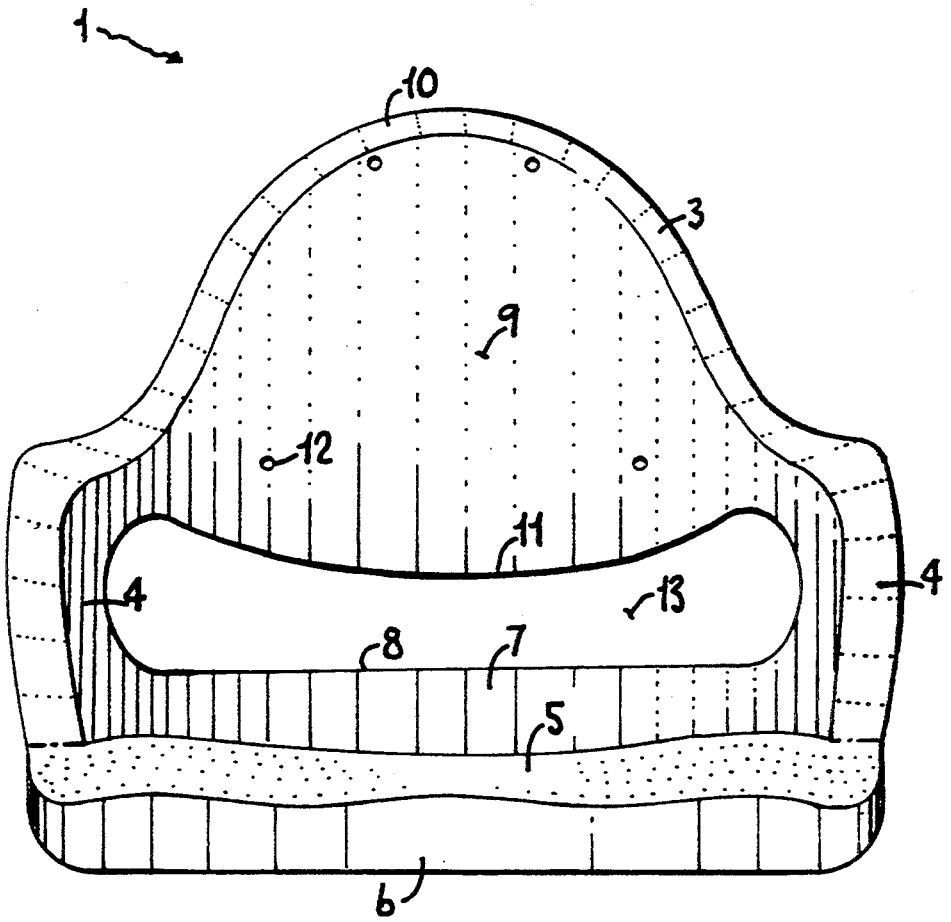
FIG. 1 is a front elevational view of the preferred embodiment of the single piece chair shell of this invention.

FIGS. 1–5 illustrate five views of the preferred embodiment of the single piece chair shell of this invention. As shown in these figures, the chair shell 1 of this invention is formed or molded out of a single, unitary piece of high strength resilient plastic or a plastic composite. A suitable plastic material is a fiberglass reinforced thermoplastic resin. The chair shell 1 may be covered with a foam padding and fabric or left uncovered. The basic chair shell 1 can be easily adapted to the construction of chairs of a variety of configurations and supporting armrests, legs and bases, such as a metal tubular sled type of leg base 19, illustrated in FIG. 5. The basic chair shell 1 is comprised of a seat member 2, a back member 3 and a pair of connecting torsion links 4, all of which are formed as a single piece unitary chair shell structure.

The seat member 2, of the chair shell 1, has a compoundly curved seat pan 5 shaped generally to conform to a human posterior. The seat pan 5 is provided with a downwardly directed curved front portion 6 that supports the mid-thighs of the user and an upwardly directed curved rear portion 7 that terminates in a substantially horizontal, rearwardly directed lip 8. The seat pan 5 preferably slopes slightly downwardly (about 10 degrees) from the curved front portion 6 to the curved rear portion 7. The underside of the seat member 2 is provided with integrally molded or separately attached fittings 18 for attaching a leg base, such as the metal tubular sled type of leg base 19, shown in FIG. 5.

The back member 3 has a slightly curved backrest 9 to support the users back. The backrest 9 terminates in an upper rearwardly directed lip 10 and a lower rearwardly directed lip 11 which strengthen the backrest 9 and keep any edges away from the body of the user. The upper rearwardly directed lip 10 also serves as a convenient handle to facilitate the lifting and moving of the chair by the user. As shown best in FIG. 1, the lower part of the backrest 9 and the lower lip 11 are curved so that the center of the lower part of the backrest 9 and the lower lip 11 are closer to the rearwardly directed substantially horizontal lip 8 of the seat 2. If desired, the backrest 9 may be provided with inserts or openings 12, to provide attachments for a cushion or upholstery.

As best illustrated in FIG. 1, the seat member 2 and the back member 3 are separated by an opening 13 that resembles a collapsed ellipse, the sides of which curve and merge into the connecting torsion links 4. The bottom of the collapsed elliptical opening 13 is formed by the substantially horizontal rearwardly directed lip 8 of the seat member 2. The top of the opening 13 is formed by the lower lip 11 of the back member 3 which, as best illustrated in FIG. 1, curves downwardly towards the bottom center of the back member 3, to resemble a collapsed ellipse when viewed from the front.

As will be discussed later, the collapsed elliptical opening 13 allows for the back member 2 to deflect and flex independently of the seat member 2 in response to the weight, movement and position of the user.

Figure 2:
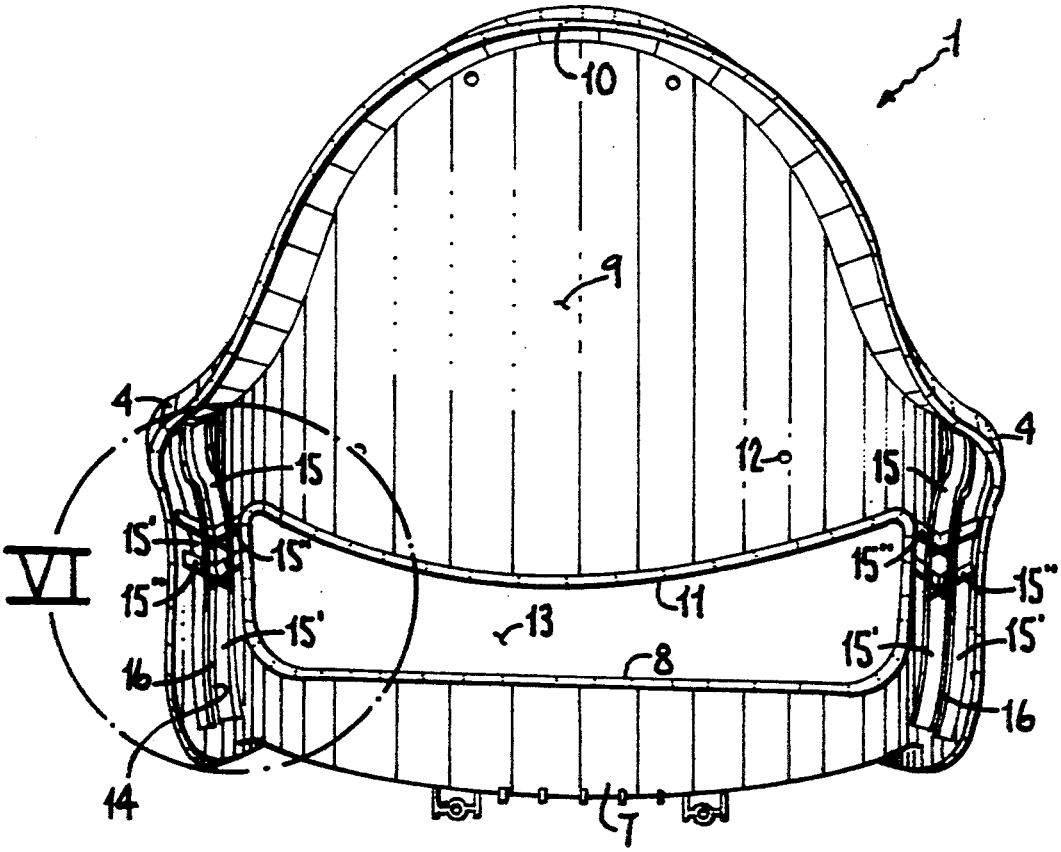
FIG. 2 is a rear elevational view of the preferred embodiment of the single piece chair shell of this invention.
Figure 3:
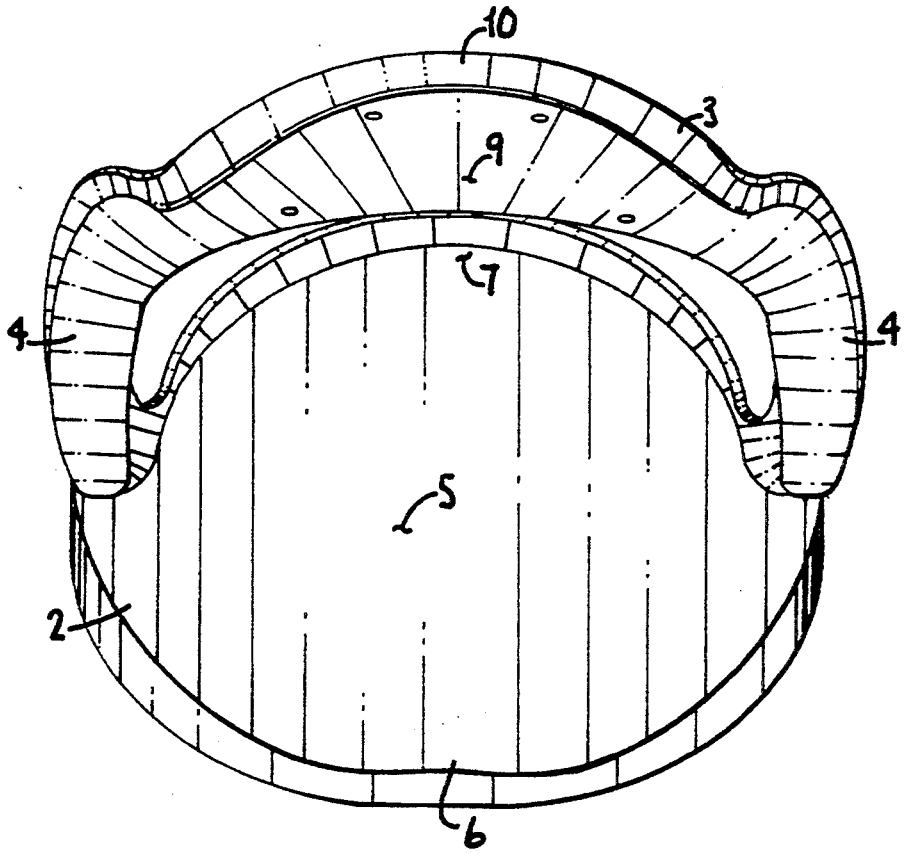
FIG. 3 is a top view of the preferred embodiment of the single piece chair shell of this invention.
Figure 4:
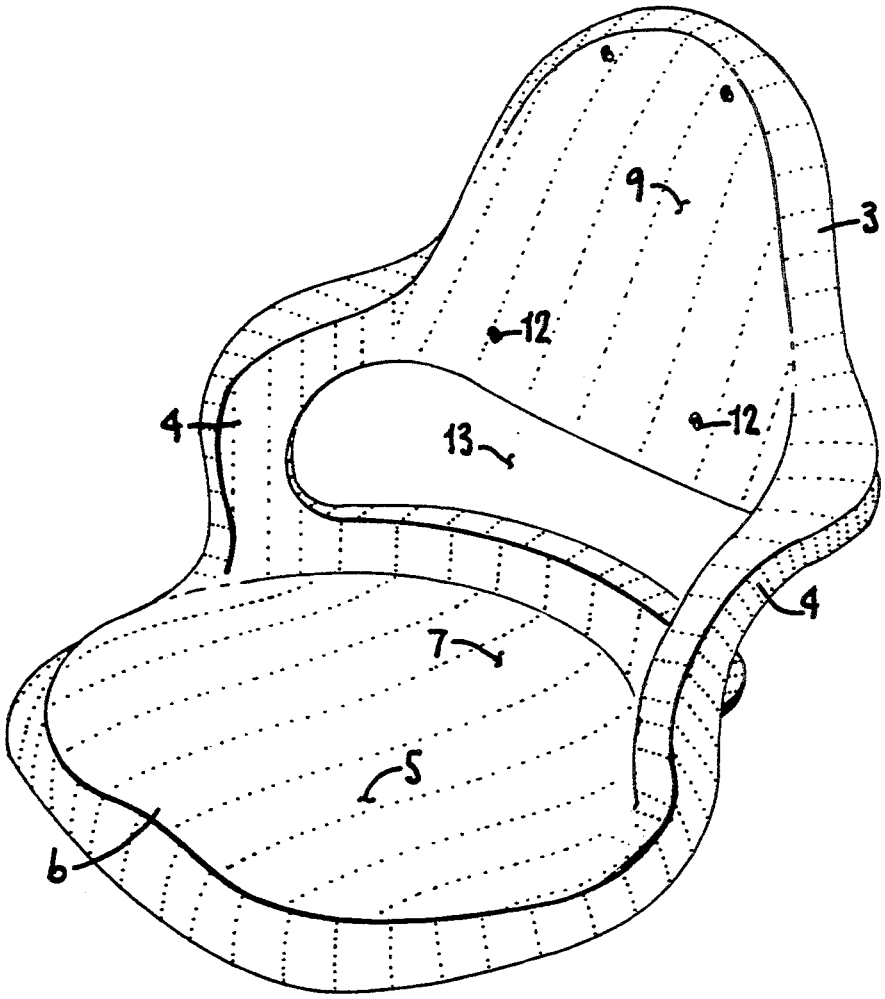
FIG. 4 is an isometric view of the preferred embodiment of the single piece chair shell of this invention.
Figure 6:
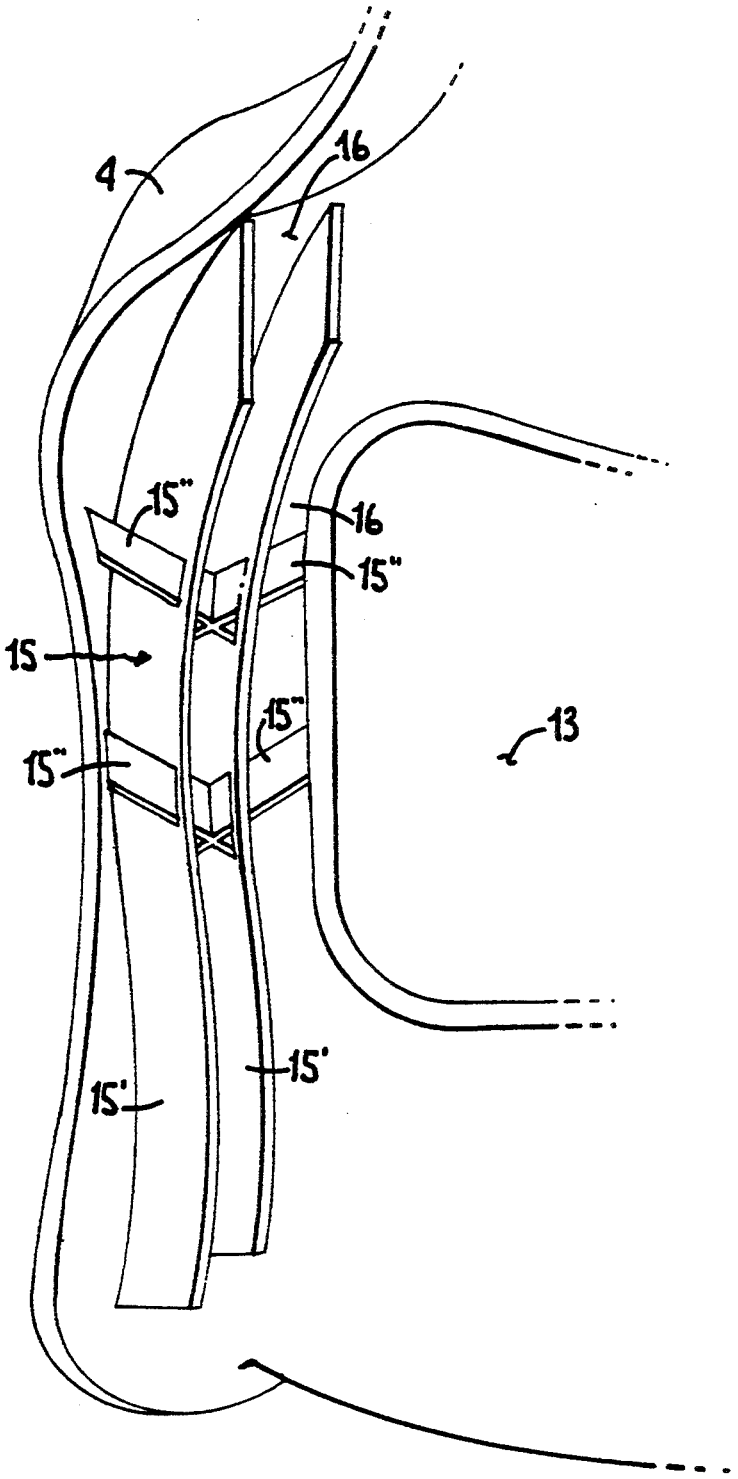
FIG. 6 is an enlarged rear view of the portion of one of the arm support members within the circled area marked VI shown on FIG. 2.

The connecting torsion links 4 are each comprised of a curved, substantially U-shaped, channel 14 open to the rear which are adapted to act as torsion springs to torsionally control the deflection of the back member 3 relative to the seat member 2 when pressure is applied against the back member 3 by the user. The connecting torsion links 4, in this embodiment are preferably provided with a plurality of spaced web members 15 that project from the base 16 of the channel 14. As best illustrated in FIGS. 2 and 6, several of the web members 15' extend parallel to the outer wall 17 of the channel 14 and several of the web members 15'' are oblique to the outer wall 17 of the channel 14 and intersect each other between a pair of web members 15' that extend parallel to the outer wall 17 of the channel 14. The depth of each of the web members 15, measured from the base 16 of the channel 14 is selected in accordance with the desired torsional spring rate for the connecting torsion links 4, which act as torsion springs connecting the seat member 2 and the back member 3.

When a user sits in the chair 1, the connecting torsion links 4, which act as torsion springs, and the collapsed elliptical opening 13 cooperate with each other and allow an initial flexure or movement downwardly and rearwardly of the back member 3 in response to the weight, movement and position of the user.

If increased pressure is applied by the user to the back member 3, the connecting torsion links 4 allow the back member 3 to flex rearwardly and downwardly until the center portion of the lower lip 11 of the back member 3 contacts the center portion of the rearwardly directed lip 8 of the seat member 2. This contact between the bottom of the back member 3 and the rear of the seat member 2 prevents further rearward and downward movement and flexure of the back member 3 and acts as a stop to prevent overstressing the connecting torsion links 4.

The curved connecting torsion links 4 are also in a position so that they will serve to support the elbows of the user when the chair is positioned next to a horizontal desk or work station surface and thereby provide additional comfort to the upper arms of the user while at work. In addition, the compoundly curved seat pan 5 and the backrest 9 are so shaped and designed to provide maximum comfort and support for the body of the user and also allow free, unrestrained shoulder movement when the user is engaged in work at a horizontal desk or a work station surface.

Figure 5:
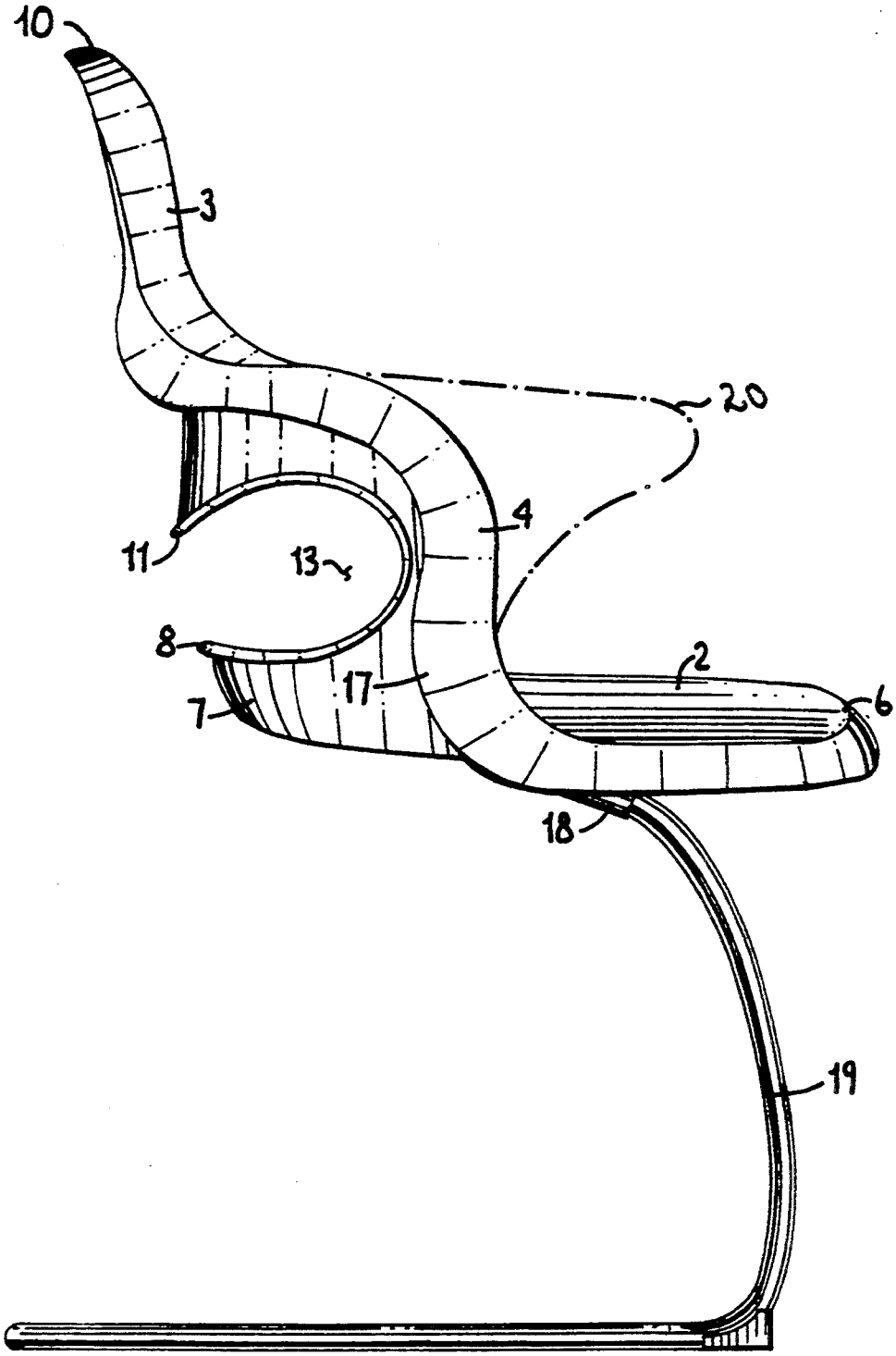
FIG. 5 side view of the preferred embodiment of the single piece chair shell of this invention fitted with a metal tubular sled type of leg base and optional armrests, shown in broken lines.

While we have illustrated a metal tubular sled type of chair support base 19 in FIG. 5, the chair shell 1 of this invention may be easily adapted by those skilled in chair manufacturing to other types of chair support bases. We have also illustrated in FIG. 5, in broken lines, an example of a pair of typical armrest support members 20 that may be attached to the chair shell 1, if desired, and which fit over and are supported by the connecting torsion links 4. The armrest support members 20 tilt rearwardly along with any rearward tilt of the back member 3 and thereby provide lower arm support for the user both in the upright and tilted positions of the chair.

The chair shell 1 of this invention is therefore able to serve as a universal and versatile basic chair shell that can be easily adapted or modified to provide a large variety of different chair designs and constructions.

While we have described this invention by illustrating and describing the preferred embodiment of it, we have done this by way of example, and are not to be limited thereby as there are modifications and adaptations of this embodiment that could be made within the scope of this invention.

We claim:

1. A single piece molded resin chair shell comprising a seat member, a back member, and a pair of integral connecting torsion links, the back of said seat member and the bottom of said back member being separated by a collapsed elliptical opening extending between said connecting torsion links, each connecting torsion link being comprised of a curved, substantially U-shaped channel adapted to control the deflection of said back member relative to said seat member when pressure is applied against said back member.

2. The chair shell of claim 1 in which the connecting torsion links are adapted to support the elbows of the user.

3. The chair shell of claim 1 in which the connecting torsion links are adapted to support a pair of armrest support members.

4. The chair shell of claim 1 in which the bottom of said back member and the back of said seat member serve as a stop to prevent excessive flexing of said back member.

5. The chair shell of claim 1 in which said seat member is compoundly curved.

6. The chair shell of claim 1 in which said back member supports the back but not the shoulders of the user.

7. The chair shell of claim 1 in which the top of said member is provided with a rearwardly extending lip adapted to serve as a lifting and moving handle.

8. The chair shell of claim 1 in which each of said curved, substantially U-shaped channels is provided with a plurality of web members projecting from the base of each of said channels.

9. The chair shell of claim 8 in which the depth of projection of the web members is selected in accordance with the desired torsional spring rate for the connecting torsion links.

10. The chair shell of claim 8 in which at least two of the web members extend parallel to the outer wall of each of said U-shaped channels.

11. The chair shell of claim 8 in which at least two of the web members are oblique to the outer wall of each of said U-shaped channels.

12. The chair shell of claim 11 in which the oblique web members intersect each other between two of said parallel extending web members.

13. The chair shell of claim 11 in which several of the oblique web members extend between the outer wall of one of said U-shaped channels and a parallel extending web member.

* * * * *